United States Patent [19]

Amrhein

[11] 4,252,467

[45] Feb. 24, 1981

[54] SUSPENSION APPARATUS FOR ATTACHING A SUBMARINE TO A SUBMERGED STRUCTURE

[75] Inventor: Marcel M. Amrhein, Marseilles, France

[73] Assignee: S.A. Intersub - International Submarine Services, Marseilles, France

[21] Appl. No.: 942,636

[22] Filed: Sep. 15, 1978

[30] Foreign Application Priority Data

Oct. 11, 1977 [FR] France ..... 77 31372

[51] Int. Cl.[2] ..... B63C 11/00

[52] U.S. Cl. ..... 405/188; 114/313; 114/322; 294/66 R; 405/185

[58] Field of Search ..... 405/66, 185, 188, 189; 114/50, 51, 230, 312, 313, 322; 244/115; 294/66 R, 74, 75, 86 R; 242/86.5 R

[56] References Cited

U.S. PATENT DOCUMENTS

| | | | |
|---|---|---|---|
| 1,616,410 | 2/1927 | Buell | 114/51 |
| 3,191,787 | 6/1965 | Stearn | 294/74 X |
| 3,367,299 | 2/1968 | Sayre | 114/51 |
| 3,550,388 | 12/1970 | Smith et al. | 114/312 X |
| 3,698,197 | 10/1972 | Bodey et al. | 405/188 |
| 3,851,613 | 12/1974 | Armour | 114/230 |
| 4,089,178 | 5/1978 | Kinase et al. | 405/66 |

*Primary Examiner*—David H. Corbin

*Attorney, Agent, or Firm*—Lewis H. Eslinger

[57] ABSTRACT

An apparatus according to the invention for suspending a submarine on a submerged structure and comprising a preshaped semi-rigid strap wound onto a drum disposed in a casing fixed to said submarine, whereby the strap when unwound adopts the shape of a generally circular loop so as to pass round one of the cross-members of the submerged structure and has at its free end means for cooperating with a locking device disposed on the path adopted by the strap with respect to the casing, whereby the locking device comprises safety means for bringing about the release thereof in the case of a defect to the locking system.

12 Claims, 9 Drawing Figures

1
1a
1b
1b
6
2
1b
6
6
2

SUSPENSION APPARATUS FOR ATTACHING A SUBMARINE TO A SUBMERGED STRUCTURE

BACKGROUND OF THE INVENTION

The present invention relates to a suspension apparatus for immobilizing a submarine on a submerged structure.

The technical field of the invention is that of equipment used in the field of underwater operations.

The inspection and maintenance of oil drilling platforms at sea require the use of divers for the positioning of measuring pick-up. In general, the divers are brought to their working location by diving bells which have a very considerable vertical mobility, but no horizontal mobility. However, the inspection of platforms requires the divers to have access not only to the exterior of the supporting structure, but also to its interior. In view of the dimensions involved, such an access is impossible from diving bells.

Means for suspending submarines on a submerged structure are known. Such a known apparatus comprises a system of hook-like ramps which surround a cross-member of the structure, thus ensuring the maintaining in a fixed position relative to the platform structure of the submarine.

BRIEF SUMMARY OF THE INVENTION

The problem of the present invention is to provide a novel apparatus for attaching a submarine to a structure.

According to the invention, this problem is solved by an attachment apparatus, wherein it comprises a preshaped, semi-rigid strap which is wound onto a drum located in a casing fixed to the submarine, whereby when unwound, said strap adopts the shape of a generally circular loop so as to pass round a cross-member of said submerged structure and has at its free end means for cooperating with a locking device disposed on the route adopted by the strap with respect to the casing.

Thus, the invention provides an apparatus making it possible to suspend a submarine on one of the horizontal tubes of a submerged structure, whereby the diameter is of an arbitrary nature, but is generally between 400 and 2400 mm.

The advantages of such an apparatus are listed below:

the apparatus can be strapped to different sections of tubes;

the apparatus is retractable and has reduced overall dimensions in the retracted position, whilst being protected by protective ramps located in the upper part of the submarine;

the system has a low weight due to the use of very strong textile straps;

the safety and reliability of the system is ensured due to the existence of a jettisoning or release device on the locking funnel, whereby when it is not possible to unlock the strap, said release device makes it possible to completely release the locking funnel, thus permitting the strap to be wound into its casing. The funnel is released by means of pneumatic jacks.

It is stressed that said safety device operates on a circuit which differs from that supplying the other parts of the equipment, which are supplied by a hydraulic circuit.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
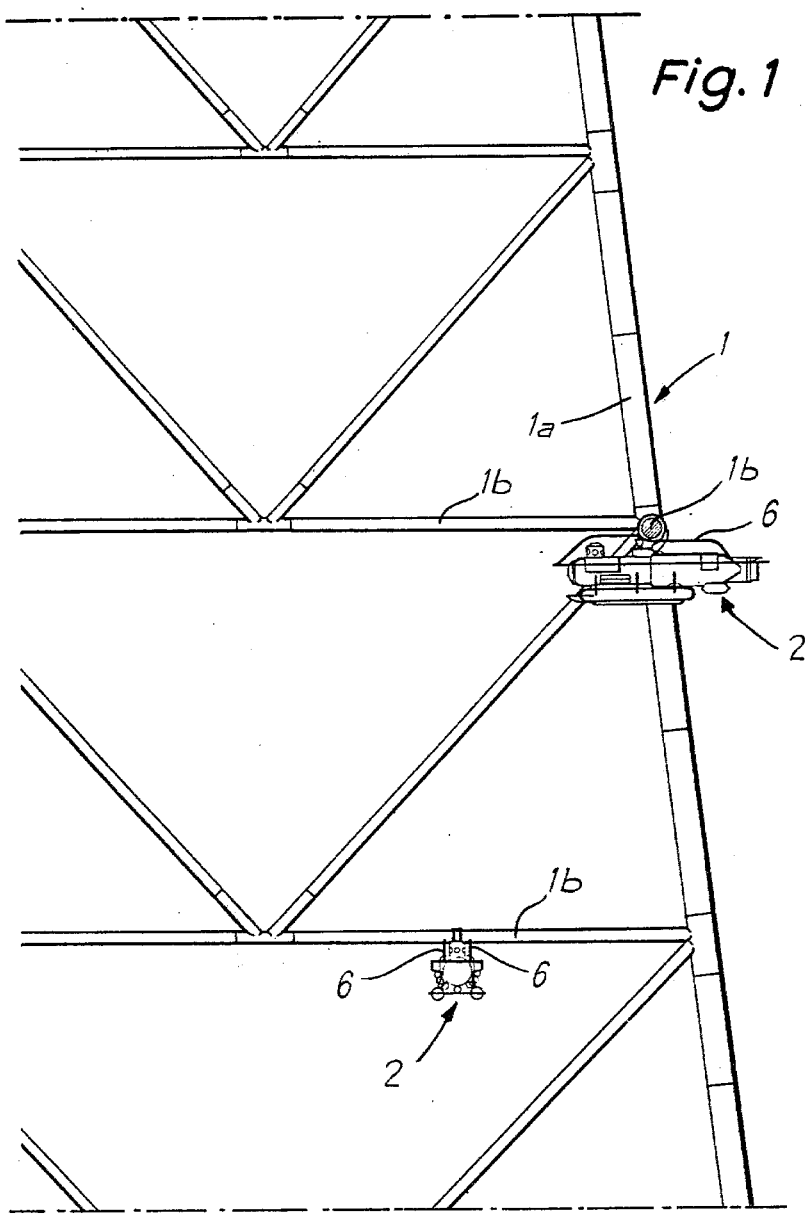
FIG. 1 a part elevation of a submerged structure illustrating two submarines in the attached position.

Reference is firstly made to FIG. 1 which shows a submerged structure 1, for example a platform moored at sea and which more particularly comprises oblique columns 1*a* and horizontal cross-members 1*b* interconnecting said columns 1*a*. In FIG. 1 a submarine 2 is shown in side plan and rear views, suspended on two cross-members 1*b*.

Figure 2:
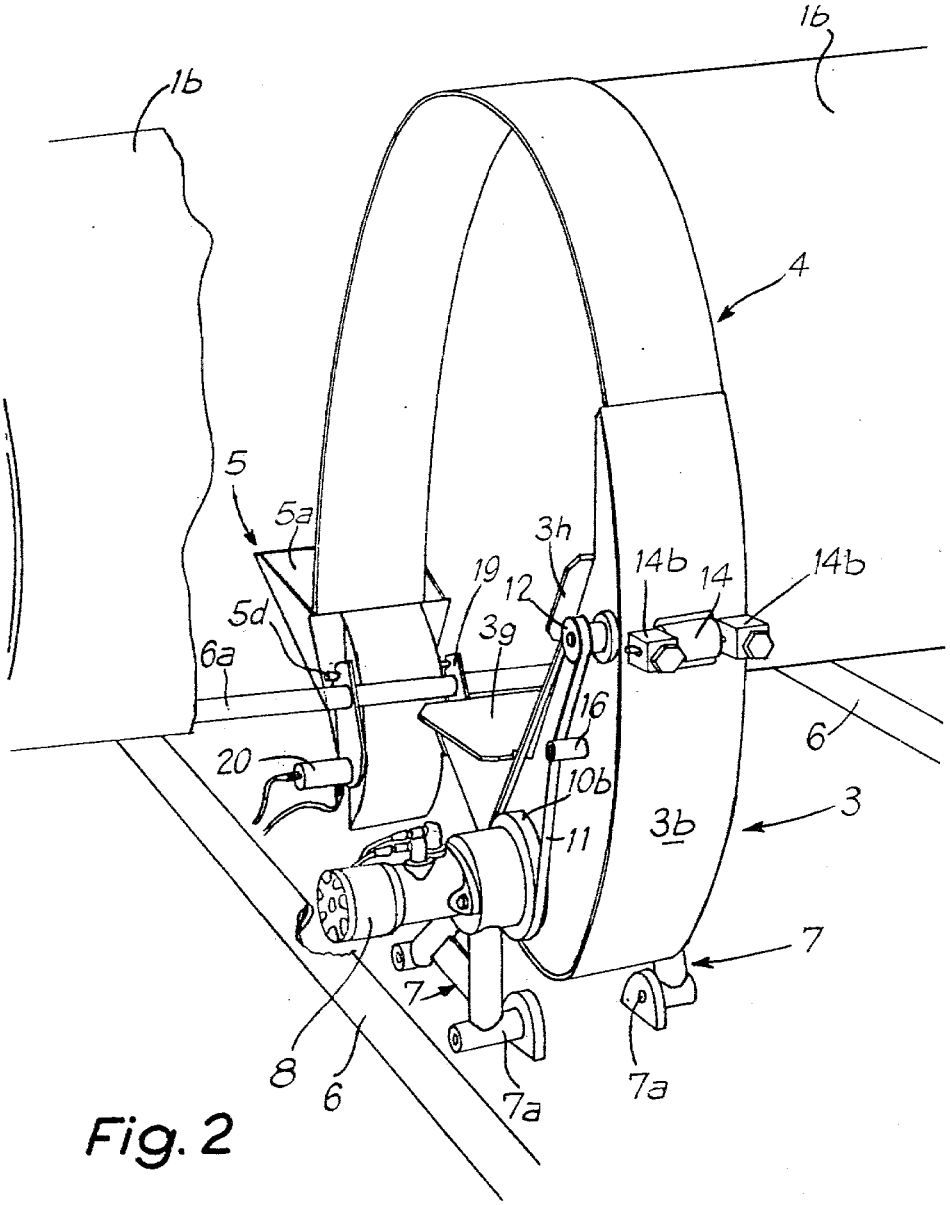
FIG. 2 a perspective view of a suspension system according to the invention.

The suspension or attachment of the submarine on said structure is realised by means of an apparatus according to the invention illustrated in perspective in FIG. 2. This apparatus essentially comprises a casing 3 serving as a guide for the winding and unwinding of a strap 4 and a locking device 5. The apparatus is located essentially to the right of the fixing member for handling the submarine and therefore between two guidance ramps or guards 6 extending over the length of the submarine parallel to and on either side of its longitudinal axis.

When submarine 2 approaches structure 1, it is supported on the guards by sliding thereon until it arrives in the attachment position to the structure and this attachment operation will be described in greater detail hereinater.

Figure 3:
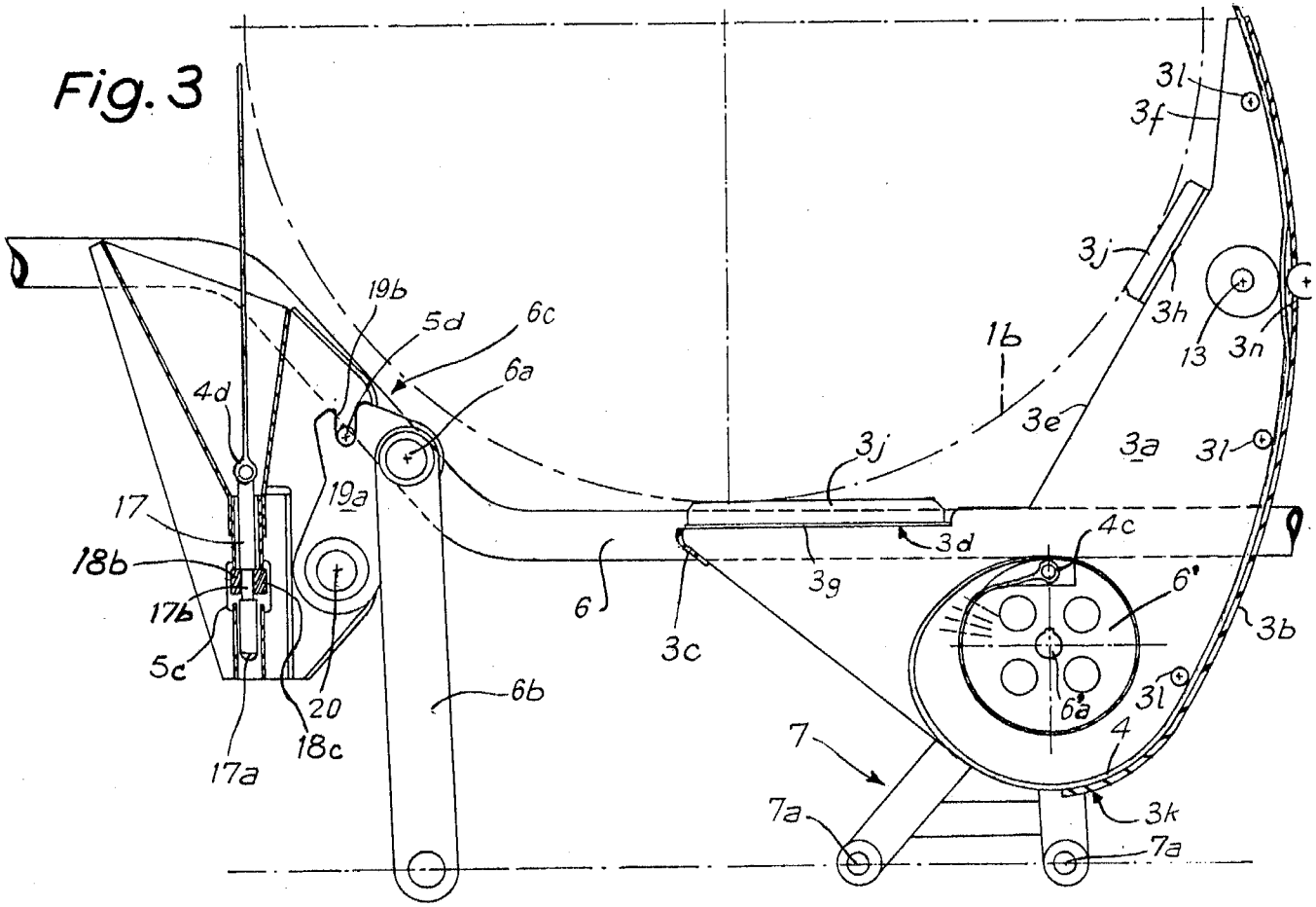
FIG. 3 a sectional view of the apparatus of FIG. 2.
Figure 5:
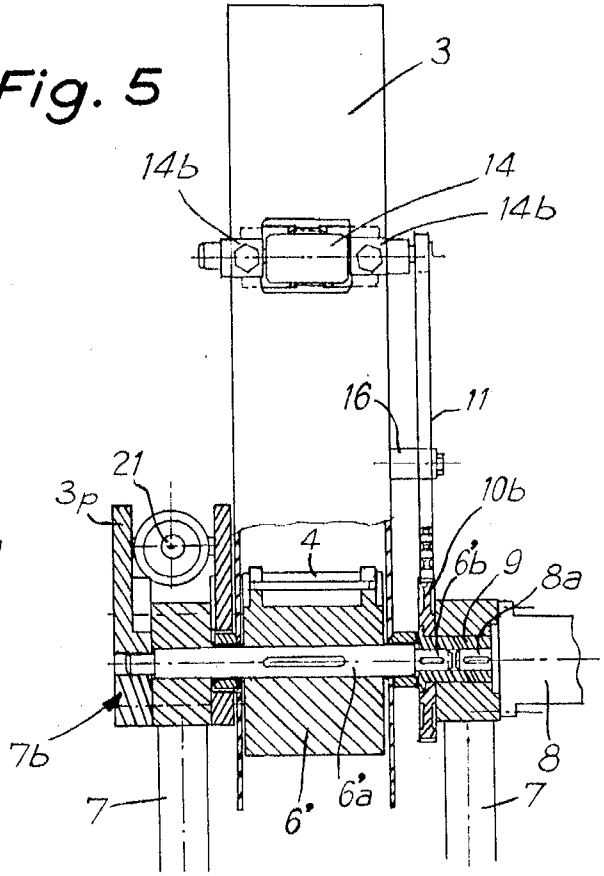
FIG. 5 a view from the left of the casing of FIG. 4 in part section illustrating the strap drive mechanism.
Figure 4:
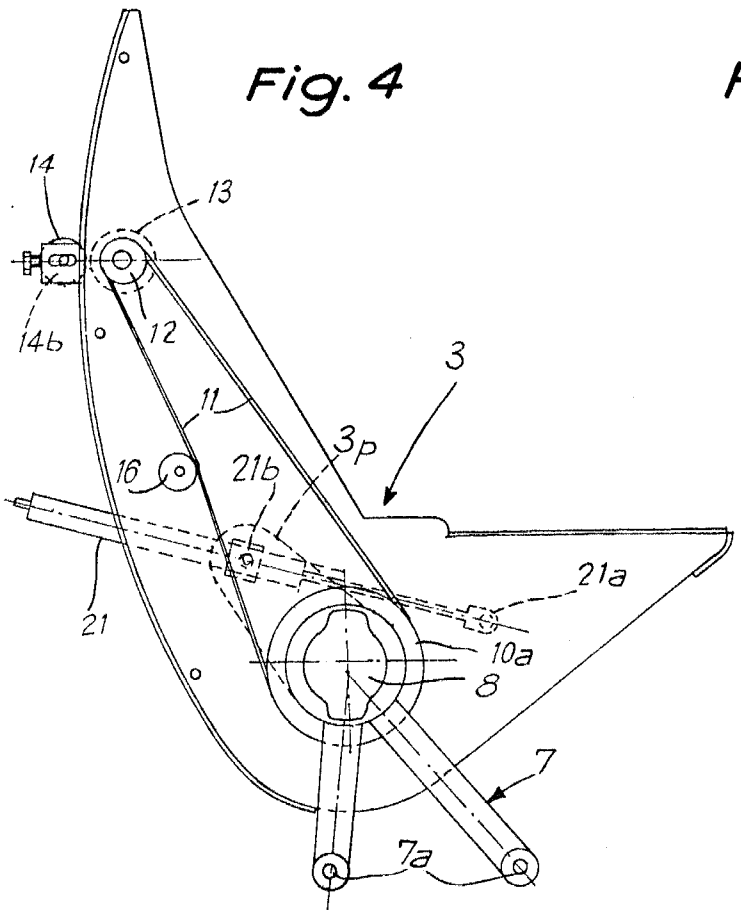
FIG. 4 an elevation of the casing in which is wound the suspension strap.

Reference will now be made to FIGS. 2 to 7 which illustrate the various components of casing 3. The latter is in the general form of a cradle and has two side walls 3*a* interconnected by a curved and upwardly extending wall 3*b*, whilst on the opposite side to wall 3*b* there is a cross-member 3*c*. As shown in FIG. 3, the upper part of walls 3*a* is shaped in such a way that they partly surround a cross-member 1*b* of the structure to which attachment is to be effected. Thus, the profile of these walls is in accordance with a substantially horizontal line 3*d* extending from cross-member 3*c* over a portion of the casing length, an oblique line 3*e* approximately 120° from line 3*d* and finally line 3*f* forming an angle of 95° with line 3*d*.

Along lines 3*d* and 3*e*, the casing has abutment plates 3*g*/3*h* disposed transversely to walls 3*a* to which are fixed the PVC buffer plates 3*j* which dampen the engagement contact between structure 1 and submarine 2.

In its centre, casing 3 has a reel or drum 6' rotating on a shaft 6'*a* disposed transversely to casing 3 and perpendicularly to walls 3*a*. The shape of the lower part of casing 3 is such that at 3*k* its profile is substantially parallel to the peripheral contour of drum 6'. The latter permits the winding and unwinding of strap 4 which, previously preshaped so that it winds onto itself, conforms to the curvature of wall 3*b* of the casing and retains its curvature after being drawn out of the latter in such a way that it passes round the cross-member 1*b* of the structure. Strap 4 is kept applied against wall 3*b* by means of rollers 3*l* disposed on an axis parallel to wall 3*b*. Casing 3 is mounted on a support 7 fixed to the submarine by its lower end 7*a*.

The strap is wound and unwound by means of a motor, for example a hydraulic motor 8, carried by support 7 and whose output shaft 8*a* is keyed to a coupling box 9, itself keyed to end 6'*b* of shaft 6'*a*. The other end 6'*c* of said shaft is mounted in a bearing 7*b* of the support 7.

The coupling box 9 has a toothed wheel 10*b* which cooperates with a toothed belt 11, which winds round a toothed pinion 12 disposed on the side of the upper part of casing 3. This pinion 12 is keyed to the end of a shaft 13 which passes from one side of the casing to the other, whilst being parallel to wall 3*b* of said casing and mounted on two bearings 3*m* fixed to walls 3*a*. The casing has an opening 3*n* facing shaft 13 so as to permit the passage of a so-called pressing roller 14, which rotates freely on a shaft 14*a* parallel to shaft 13. This roller is mounted on two supports 14*b* fixed to said casing 3 and is pushed from the inside thereof by springs 14*c*, whose setting is obtained by means of screws 14*d* cooperating with tapped holes made in each of the supports 14*b*.

Figure 6:
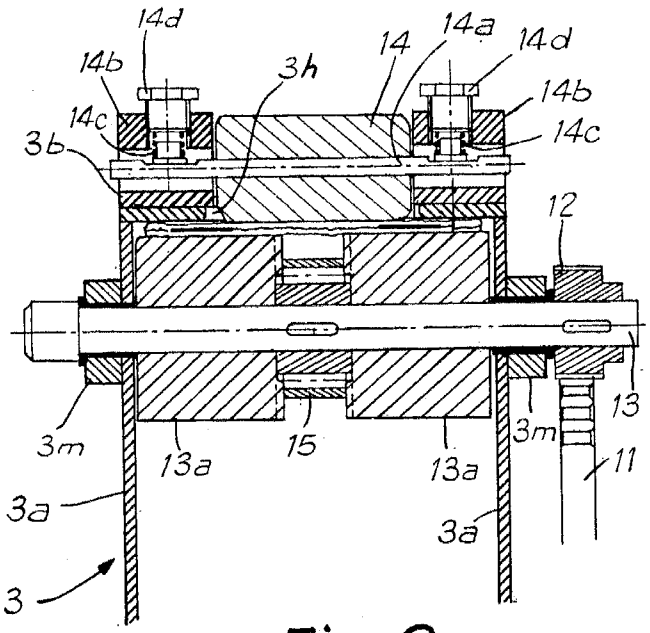
FIG. 6 a larger scale sectional view of the strap unwinding device.
Figure 7:
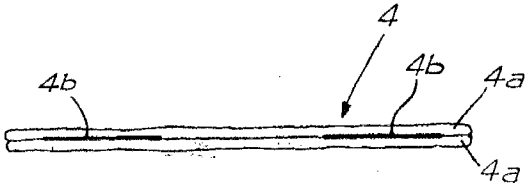
FIG. 7 a cross-sectional view of the strap.
Figure 9:
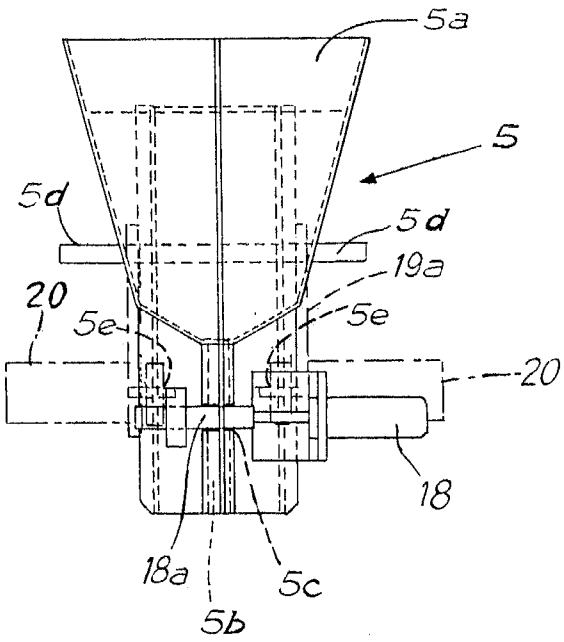
FIG. 9 a view from the left of the funnel of FIG. 8.
Figure 8:
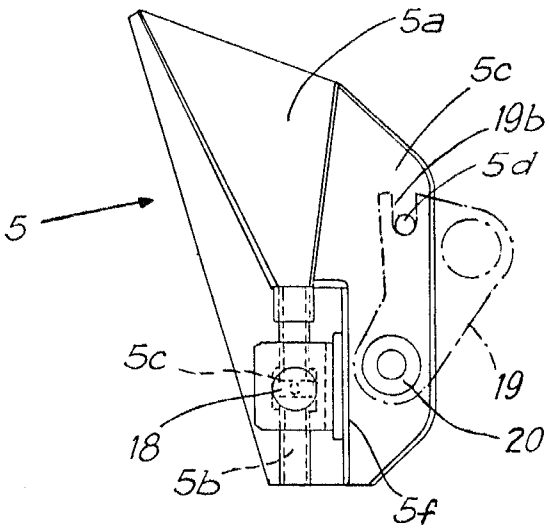
FIG. 8 an elevation of the strap locking funnel.

Shaft 13 carries the so-called driving rollers 13*a* keyed to said shaft 13 via a "free wheel" 15. The driving rollers 13*a* are located on either side of free wheel 15 in such a way that the driving device extends over the width of the casing (FIG. 6). As shown in FIG. 6, strap 4 is inserted between the pressing roller 14 and the driving rollers 13*a*. A tension roller 16 located on the route of one of the straps of the toothed belt 11 ensures the tensioning of the latter.

Strap 4 (FIG. 7) comprises two textile belts 4*a* connected to one another for example by stitching and inserting two preshaped spring blades 4*b* in such a way that the strap winds onto itself. One end 4*c* is fixed to drum 6' and has at the other 4*d* a locking finger 17 having a generally cylindrical configuration, whose free end 17*a* is profiled, whilst its centre portion has a cylindrical constriction 17*b*.

Finger 17 cooperates with the locking device 5, located facing casing 3 in such a way that it surrounds cross-member 1*b* of the submerged structure. The locking device comprises a pyramidal funnel 5*a* ensuring the reception of finger 17, whilst the lower part of the funnel 5*a* is extended by a cylindrical passage 5*b* which receives finger 17 and acts as a notch. Funnel 5*a* and its passage 5*b* have a metallic structure 5*f* on which is mounted a double acting hydraulic jack 18, whose longitudinal axis extends transversely to passage 5*b*. At the end of its movable rod, this jack carries a locking fork arm 18*a* traversing said passage at 5*c* and which cooperates with the constriction 17*b* of finger 17. The fork arm has a profiled opening with two sections 18*b* and 18*c* in order to permit in a first retracted position the passage of the finger and in a second extended position its locking or vice versa.

The locking device 5 is carried by a support 19 having two parallel flanges 19*a* and of the same shape, spaced so as to permit the passage of structure 5*c* of device 5. The flanges are fixed to a tubular cross-member 6*a* which connects the guards 6. Columns 6*b* support both support 19 and guards 6. In the upper part of support 19 there are two channels which form slides 19*b* in flanges 19*a*. These slides face one another and are substantially vertical and of short length. Each of them receives a suspension arm 5*d* extending perpendicularly to the locking device 5 and to its lower part. Device 5 is secured by a double locking means. To this end, jacks 20 are fixed to the outside of the flanges 19*a* of support 19 in such a way that each of them is traversed by the movable rod of the jack which it supports. Thus, jacks 20 are in opposition on the same transverse axis to support 19 and are perpendicular to flanges 19*a*. Their movable rod constitutes a locking finger which penetrates an opening 5*e* in the metal structure 5*c* of device 5. These double acting jacks operate pneumatically and constitute a safety device. They serve to release or jettison the funnel 5 in the case where for some reason it is impossible to disengage strap 4 from locking device 5. It is clear that as a result of the operation of jacks 20 with their movable rods retracted, device 5 subject to a tensile force exerted by strap 4 is detached from support 19 and slides in slides 19*b*, thus freeing the submarine. The locking jack 18 has quick couplings which are themselves disengaged at the time of releasing device 5.

The locking device 5 is protected by guards 6 which run along the upper part of the submarine, as shown in FIG. 1. As can be seen in greater detail in FIG. 3, the device is located to the right of the counterbending 6*c* on guards 6. The special shape of the latter defines with casing 3 a recess in which is partly placed the cross-member 1 of the submerged structure.

Casing 3 is mounted so as to pivot around the axis 6'*a* of drum 6' in such a way that it can be retracted towards the right of FIG. 3, so that the curved wall 3*b* can approach the bridge of the submarine. The casing is in this position when the submarine is not attached to the structure. The rocking of the casing is obtained by means of a double acting hydraulic jack 21, articulated on the one hand at 21*a* to a structural element of the submarine and on the other at 21*b* to the lever 3*p* connected to casing 3.

With casing 3 in the working position, i.e. with wall 3*a* raised, it initially serves as a positioning abutment for the submarine relative to cross-member 1*b* and then serves as a guide for strap 4 during the winding or unwinding thereof. The strap is stored around drum 6' which is directly rotated by hydraulic motor 8. The transmission by toothed belt and pinions 10*b*, 12, 11, under the action of motor 8 drives the driving rollers 13*a* with a view to obtaining the unwinding of the strap by tension.

When the strap has passed round cross-member 1*b*, it firstly penetrates funnel 5*a* and is then locked by the locking device 18 to the right of constriction 17*a* of finger 17.

Strap 4 is wound up by motor 8 only, the latter being rotated in the reverse direction of that for unwinding. This is possible due to the fact that the driving rollers 13*a* are mounted on free wheel 15 which functions in the winding direction of strap 4.

The attachment takes place in the following manner: the submarine 2 makes its initial approach to cross-member 1*b*; the operator rocks the casing 3 so as to bring it into the operational position; the operation being continued by permitting the submarine to slide on guard 6 whilst maintaining contact with the cross-member 1 until it is immobilised against casing 3.

Once equilibrium has been obtained, the strapping of the cross-member 1 is brought about by strap 4 and the latter is locked in device 5. Finally, the assembly is completely secured to rotating hydraulic motor 8 in the opposite direction.

When the maintenance or inspection is completed, the above operations are performed in the reverse order to free the submarine.

The invention is not limited to the embodiments described and represented hereinbefore and various modifications can be made thereto without passing beyond the scope of the invention.

What is claimed is:

1. Apparatus for hooking a submarine onto an immersed structure having uprights connected by crossbars, comprising a semi-rigid and preformed strap having a free end with securing means attached thereto, a case attached to said submarine and having a rotatable drum about which said strap is wound, means for rotating the drum so as to unroll the strap which, when unrolled, takes the form of a circular-shaped loop in order to wind around one of said crossbars of the structure, and a locking device attached to said submarine for locking said securing means of the strap and having means for guiding the free end of said strap for locking in said device.

2. Apparatus according to claim 1, in which said case has a curved wall with opposed edges and two side walls attached to said edges of said curved wall, and in which said case is provided, between said side walls and adjacent the curved wall, with freely rotating rollers on axles parallel to the inner surface of said curved wall, said rollers being distributed over the length of said curved wall for guiding said strap against said inner surface of the curved wall.

3. Apparatus according to claim 1, in which said case is in the form of a cradle against which said one of said crossbars of the immersed structure presses at least at two points.

4. Apparatus according to claim 3, in which said case has an upper part, and at least one friction roller and at least one pressure roller are provided at said upper part and operate to unroll said strip from said drum.

5. Apparatus according to claim 4, in which said friction roller is mounted on a free wheel.

6. Apparatus according to claim 5, in which the drum is mounted on an axle, and said means for rotating the drum includes a motor connected to the axle of the drum, and in which a transmission means is provided for connecting said motor to said at least said one friction roller for unrolling the strap.

7. Apparatus according to claim 6, in which said motor is bi-directional and rotates the axle of the drum in one direction to unroll the strap and, in the opposite direction, to wind the strap around the drum.

8. Apparatus according to claim 1, in which said strap includes two strips of textile material which enclose at least one strip of elastic material.

9. Apparatus according to claim 1, in which said locking device has means in the shape of a pyramidal funnel defining an entry to receive and guide the free end of the strap into said locking device.

10. Apparatus according to claim 9, in which said locking device includes two lateral sides having two transverse arms extending perpendicularly therefrom and having two axially aligned grooves extending crosswise through said sides and parallel to said arms; and further comprising a support for locking said locking device to said submarine, said support having two plates including a slide in an upper portion thereof for receiving one of said respective arms, and removable rods disposed in said axially aligned grooves; and means for moving said rods into and removing said rods from said respective grooves.

11. Apparatus according to claim 9, in which the submarine includes, at an upper portion thereof, a protective structure including two guards surrounding said locking device, and in which said case is pivotally mounted around the axis of the drum and includes means which enable said case to be positioned below said guards when the locking device is not operational and to be positioned above said guards when said locking device is operational.

12. Apparatus according to claim 11, in which each said guard is in the form of a ramp which includes an upwardly inclined section which, together with said case, forms a groove to receive said crossbar of the immersed structure.

* * * * *